US010840611B1

(12) United States Patent
Martins et al.

(10) Patent No.: US 10,840,611 B1
(45) Date of Patent: Nov. 17, 2020

(54) ELECTRICAL TERMINAL AND METHOD OF FORMING SAME

(71) Applicant: Aptiv Technologies Limited, St. Michael (BB)

(72) Inventors: David B. Martins, Fall River, MA (US); Marco M. Lucci, Cranston, RI (US); Tyler Folger, Warren, RI (US)

(73) Assignee: Aptive Technologies Limited

( * ) Notice: Subject to any disclaimer, the term of this patent is extended or adjusted under 35 U.S.C. 154(b) by 0 days.

(21) Appl. No.: 16/783,253

(22) Filed: Feb. 6, 2020

(51) Int. Cl.

| | |
|---|---|
| ***H01R 4/02*** | (2006.01) |
| ***H01R 43/048*** | (2006.01) |
| ***H01R 4/58*** | (2006.01) |
| ***H01R 13/03*** | (2006.01) |

(52) U.S. Cl.
CPC ..... *H01R 4/023* (2013.01); *H01R 4/58* (2013.01); *H01R 13/03* (2013.01); *H01R 43/048* (2013.01); *H01R 2201/26* (2013.01)

(58) Field of Classification Search
CPC ..... H01R 4/023; H01R 43/048; H01R 13/03; H01R 4/58; H01R 2201/26; H01R 4/625; H01R 4/029; H01R 4/187; H01R 43/0256; H01R 12/707; H05B 2203/016
USPC ..... 439/874, 83, 876, 877, 917; 219/203, 219/522
See application file for complete search history.

(56) References Cited

U.S. PATENT DOCUMENTS

| | | | | |
|---|---|---|---|---|
| 2,709,211 | A * | 5/1955 | Glynn | H01C 1/14 338/308 |
| 6,062,920 | A * | 5/2000 | Jordan | B60R 1/088 439/861 |
| 6,267,630 | B1 | 7/2001 | Machado | |
| 6,406,337 | B1 | 6/2002 | Machado | |
| 6,685,514 | B2 * | 2/2004 | Costa | H01R 4/625 156/276 |
| 9,925,611 | B2 | 3/2018 | Mackin et al. | |
| 9,967,967 | B2 | 5/2018 | Schmalbuch et al. | |
| 10,476,217 | B2 * | 11/2019 | Guillanton | H01R 43/16 |
| 10,511,104 | B2 * | 12/2019 | Gleisberg | H01R 12/53 |

* cited by examiner

*Primary Examiner* — Travis S Chambers
(74) *Attorney, Agent, or Firm* — Billion & Armitage; Robert Myers

(57) ABSTRACT

An electrical terminal includes a planar base portion having a base portion outer surface, a base portion inner surface, and two securing tabs extending from an edge of the base portion. The electrical terminal also includes a planar attachment portion having an attachment portion outer surface, an attachment portion inner surface, and an attachment member extending from the attachment portion outer surface. The attachment member is configured to secure a wire cable to the electrical terminal. The base portion inner surface is arranged such that it is in contact with the attachment portion inner surface and the two securing tabs are bent over the attachment portion outer surface. The electrical terminal may be especially well suited for making an electrical connection to components disposed on a glass surface. A method for forming such a terminal is also presented.

20 Claims, 7 Drawing Sheets

ELECTRICAL TERMINAL AND METHOD OF FORMING SAME

TECHNICAL FIELD OF THE INVENTION

The invention generally relates to electrical terminals and more particularly to an electrical terminal configured to be mounted to a panel, such as glass panel.

BACKGROUND OF THE INVENTION

The windshield and/or rear window of automotive vehicles often have an electrical device such as an antenna or defroster formed on or in the glass. In order to electrically connect the electrical device to associated equipment, for example, a radio transceiver or defroster control, an electrical terminal is first soldered to the glass in electrical communication with the electrical device. An electrical cable extending from the associated equipment is then secured to the electrical terminal for providing electrical communication therebetween. A problem with some current electrical terminals is that the terminals can be easily separated from the glass by peeling if accidental pulling forces are exerted on the electrical cable. In addition, some electrical terminal designs are prone to cause cracking of the glass during soldering because of heat related stress concentrations formed on the glass by the footprint of the terminal. There remains a need for an electrical terminal which is resistant to the peeling and cracking issues discussed above.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

According to a first embodiment of the invention, an electrical terminal is provided. The electrical terminal includes a planar base portion having a base portion outer surface, a base portion inner surface, and two securing tabs extending from an edge of the base portion. The electrical terminal further includes a planar attachment portion having an attachment portion outer surface, an attachment portion inner surface, and an attachment member extending from the attachment portion outer surface. The attachment member is configured to secure a wire cable. The base portion inner surface is arranged such that it is in contact with the attachment portion inner surface and the two securing tabs are bent over the attachment portion outer surface.

In an example embodiment having one or more features of the electrical terminal of the previous paragraph, the base portion is integrally formed with the attachment portion and the base portion is connected to the attachment portion by a U-shaped connecting member.

In an example embodiment having one or more features of the electrical terminal of the previous paragraph, the base portion has a first curved perimeter that is generally circular in shape and the attachment portion has a second curved perimeter that is generally circular in shape.

In an example embodiment having one or more features of the electrical terminal of the previous paragraph, a first diameter of the base portion is greater than a second diameter of the attachment portion.

In an example embodiment having one or more features of the electrical terminal of the previous paragraph, the attachment member comprises an arm that extends from the attachment portion such that forces exerted on the attachment member by the wire cable are directed to a central region of the electrical terminal and the attachment member is configured to be deformed to secure the electrical terminal to the wire cable.

In an example embodiment having one or more features of the electrical terminal of the previous paragraph, the base portion and attachment portion are sized, shaped, and arranged such that forces exerted on the attachment member by the wire cable are laterally distributed across the base portion.

In an example embodiment having one or more features of the electrical terminal of the previous paragraph, the two securing tabs are arranged in opposition to one another.

In an example embodiment having one or more features of the electrical terminal of the previous paragraph, a width dimension of each of the two securing tabs is equal to 25% or more of a circumferential dimension of the base portion.

According to a second embodiment of the invention, a method of forming an electrical terminal is provided. The method includes the step of providing a sheet metal terminal preform having a top surface and a bottom surface forming a base portion with two securing tabs extending from an edge of the base portion, an attachment portion with an attachment member configured to secure a wire cable to the electrical terminal extending therefrom, and a connecting member interconnecting the base portion with the attachment portion. The method also includes the step of bending the connecting member into a U-shape such that the bottom surface of the base portion is in contact with the bottom surface of the attachment portion. The method further includes the step of bending the two securing tabs such that they are bent over the attachment portion top surface.

In an example embodiment having one or more features of the method of the previous paragraph, the base portion has a first curved perimeter that is generally circular in shape and wherein the attachment portion has a second curved perimeter that is generally circular in shape.

In an example embodiment having one or more features of the method of the previous paragraph, a first diameter of the base portion is greater than a second diameter of the attachment portion.

In an example embodiment having one or more features of the method of the previous paragraph, the attachment member comprises an arm that extends from the attachment portion such that forces exerted on the attachment member by the wire cable are directed to a central region of the electrical terminal.

In an example embodiment having one or more features of the method of the previous paragraph, the attachment member is configured to be deformed to secure the electrical terminal to the wire cable.

In an example embodiment having one or more features of the method of the previous paragraph, the two securing tabs are arranged in opposition to one another and wherein a width dimension of each of the two securing tabs is equal to 25% or more of a circumferential dimension of the base portion.

According to a third embodiment of the invention, an electrical terminal is provided. The electrical terminal is formed by a process that includes the step of providing a sheet metal terminal preform having a top surface and a bottom surface forming a base portion with two securing tabs extending from an edge of the base portion, an attachment portion with an attachment member configured to secure a wire cable to the electrical terminal extending therefrom, and a connecting member interconnecting the base portion with the attachment portion. The process also includes the step of bending the connecting member into a U-shape such that the bottom surface of the base portion is in contact with the bottom surface of the attachment portion. The method further includes the step of bending the two securing tabs such that they are bent over the attachment portion top surface.

In an example embodiment having one or more features of the electrical terminal of the previous paragraph, the base portion has a first curved perimeter that is generally circular in shape and wherein the attachment portion has a second curved perimeter that is generally circular in shape.

In an example embodiment having one or more features of the electrical terminal of the previous paragraph, a first diameter of the base portion is greater than a second diameter of the attachment portion.

In an example embodiment having one or more features of the electrical terminal of the previous paragraph, the attachment member comprises an arm that extends from the attachment portion such that forces exerted on the attachment member by the wire cable are directed to a central region of the electrical terminal.

In an example embodiment having one or more features of the electrical terminal of the previous paragraph, the attachment member is configured to be deformed to secure the electrical terminal to the wire cable.

In an example embodiment having one or more features of the electrical terminal of the previous paragraph, the two securing tabs are arranged in opposition to one another and wherein a width dimension of each of the two securing tabs is equal to 25% or more of a circumferential dimension of the base portion.

BRIEF DESCRIPTION OF THE SEVERAL VIEWS OF THE DRAWING

The present invention will now be described, by way of example with reference to the accompanying drawings, in which.

Reference numbers of similar elements in the various embodiments share the last two digits of the reference number.

DETAILED DESCRIPTION OF THE INVENTION

Figure 1:
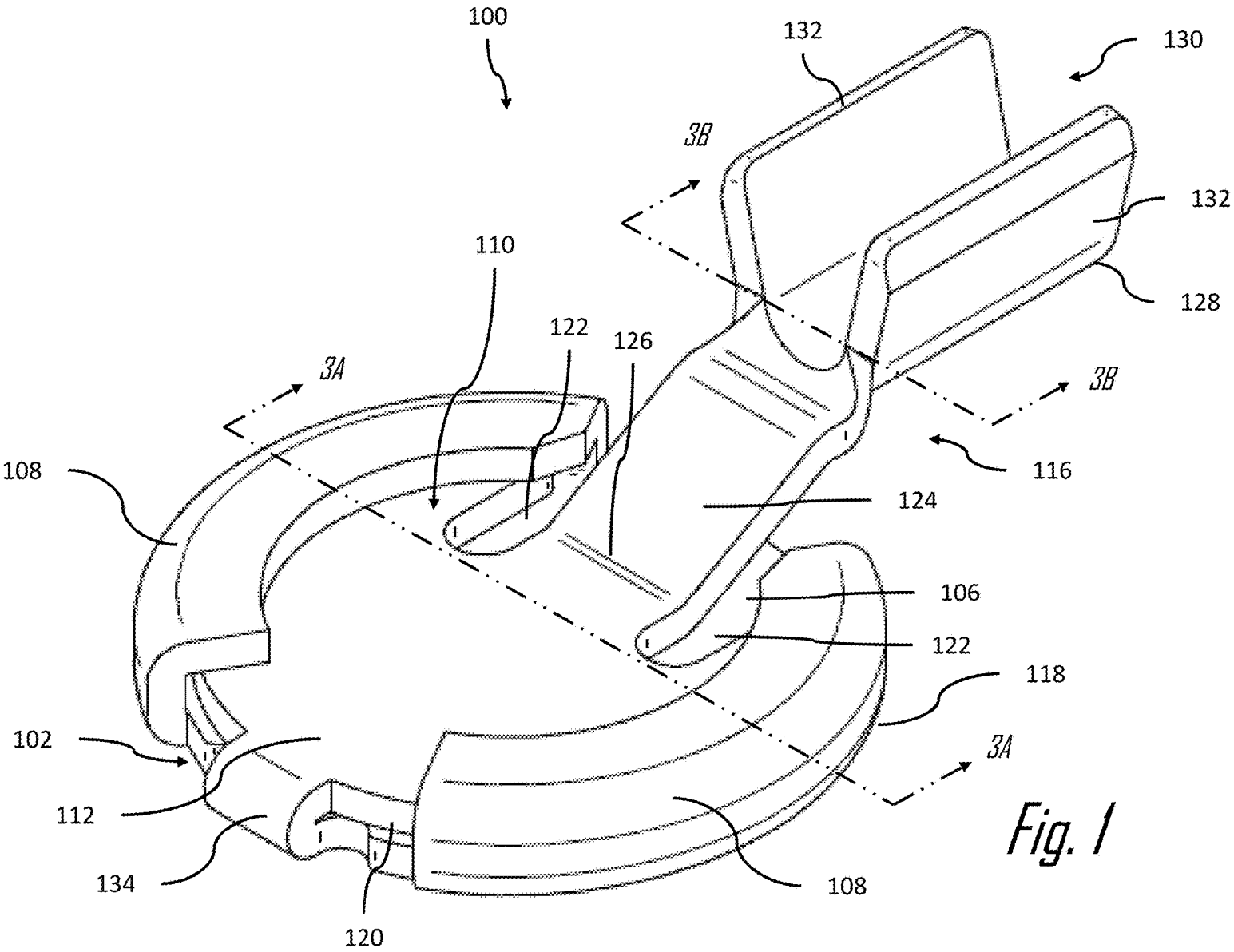
FIG. 1 is a perspective top view of an electrical connector in accordance with a first embodiment of the invention.
Figure 2:
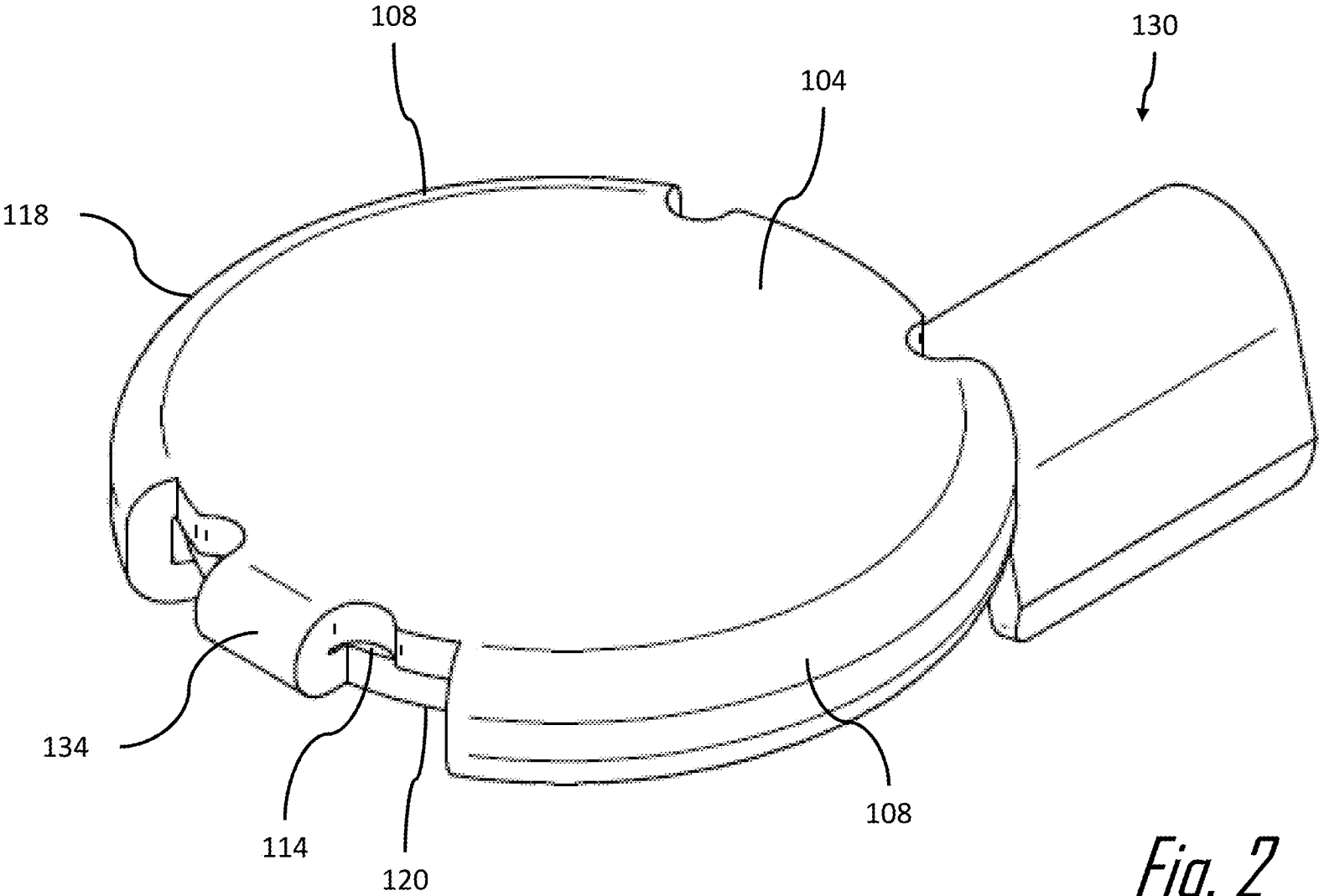
FIG. 2 is a perspective bottom view of the electrical connector of FIG. 1 in accordance with the first embodiment of the invention.
Figure 3B:
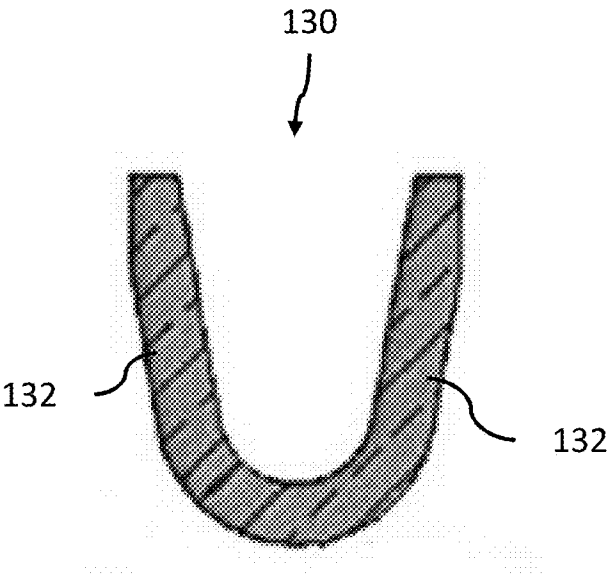
FIG. 3B is a cross section view of the electrical connector along the section line 3B-3B in FIG. 1 in accordance with the first embodiment of the invention.
Figure 3A:
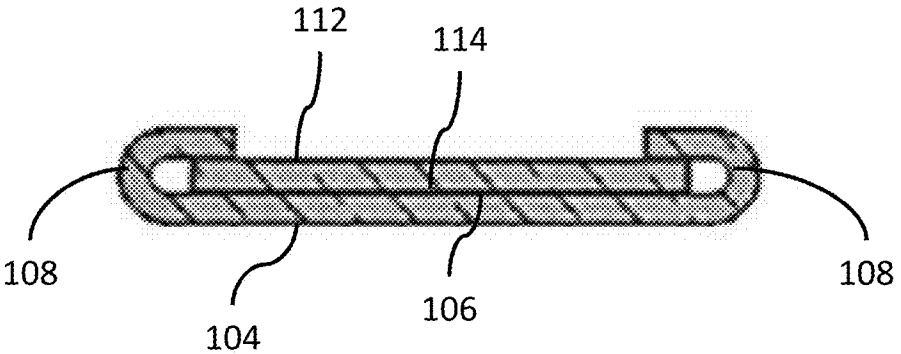
FIG. 3A is a cross section view of the electrical connector along the section line 3A-3A in FIG. 1 in accordance with the first embodiment of the invention.
Figure 4A:
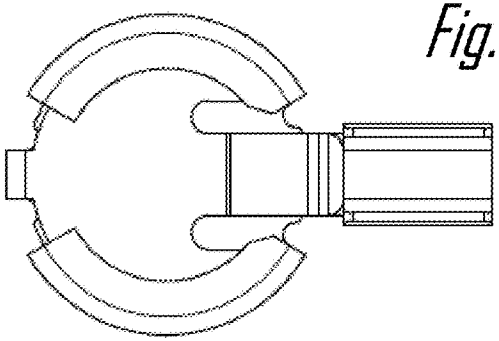
FIG. 4A is a top plan view of the electrical connector of FIG. 1 in accordance with the first embodiment of the invention.
Figure 4B:
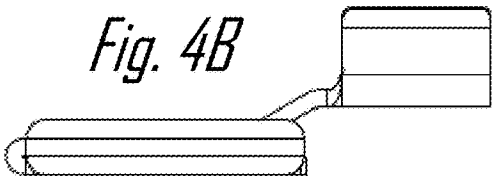
FIG. 4B is a left side plan view of the electrical connector of FIG. 1 in accordance with the first embodiment of the invention.
Figure 4D:
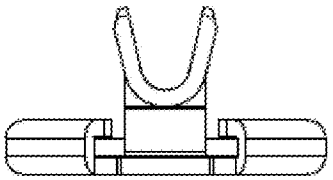
FIG. 4D is a right end plan view of the electrical connector of FIG. 1 in accordance with the first embodiment of the invention.
Figure 4C:
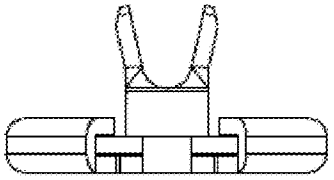
FIG. 4C is a left end plan view of the electrical connector of FIG. 1 in accordance with the first embodiment of the invention.
Figure 4E:
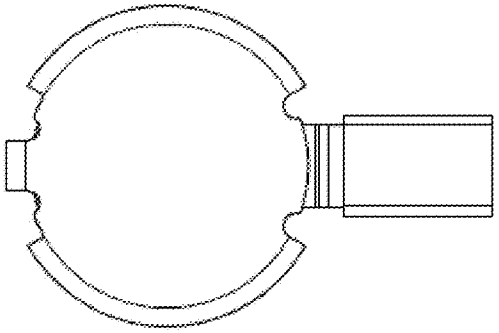
FIG. 4E is a bottom plan view of the electrical connector of FIG. 1 in accordance with the first embodiment of the invention.
Figure 4F:
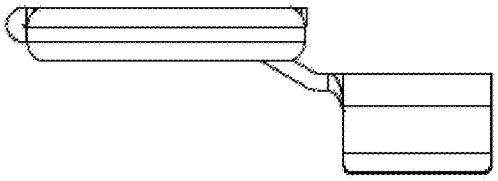
FIG. 4F is a right side plan view of the electrical connector of FIG. 1 in accordance with the first embodiment of the invention.
Figure 5B:
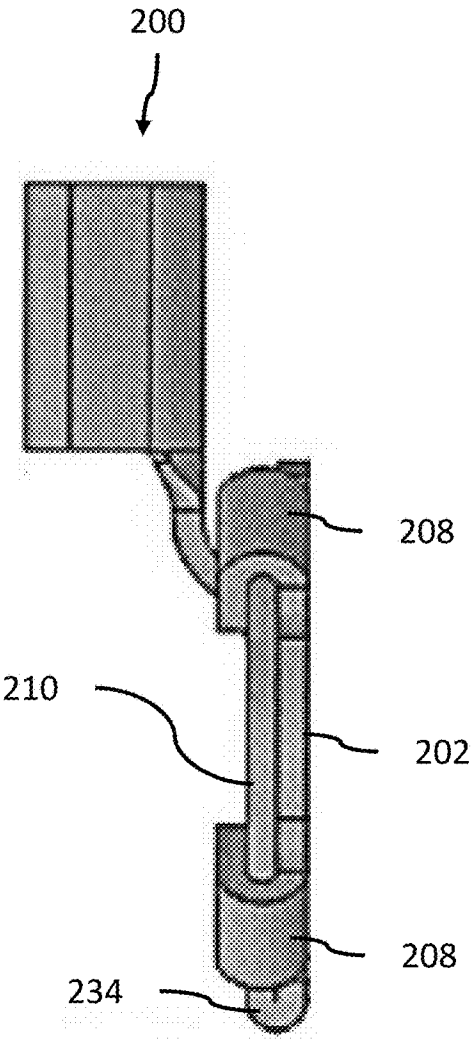
FIG. 5B is a left side plan view of the electrical connector of FIG. 5A in accordance with the second embodiment of the invention.
Figure 5A:
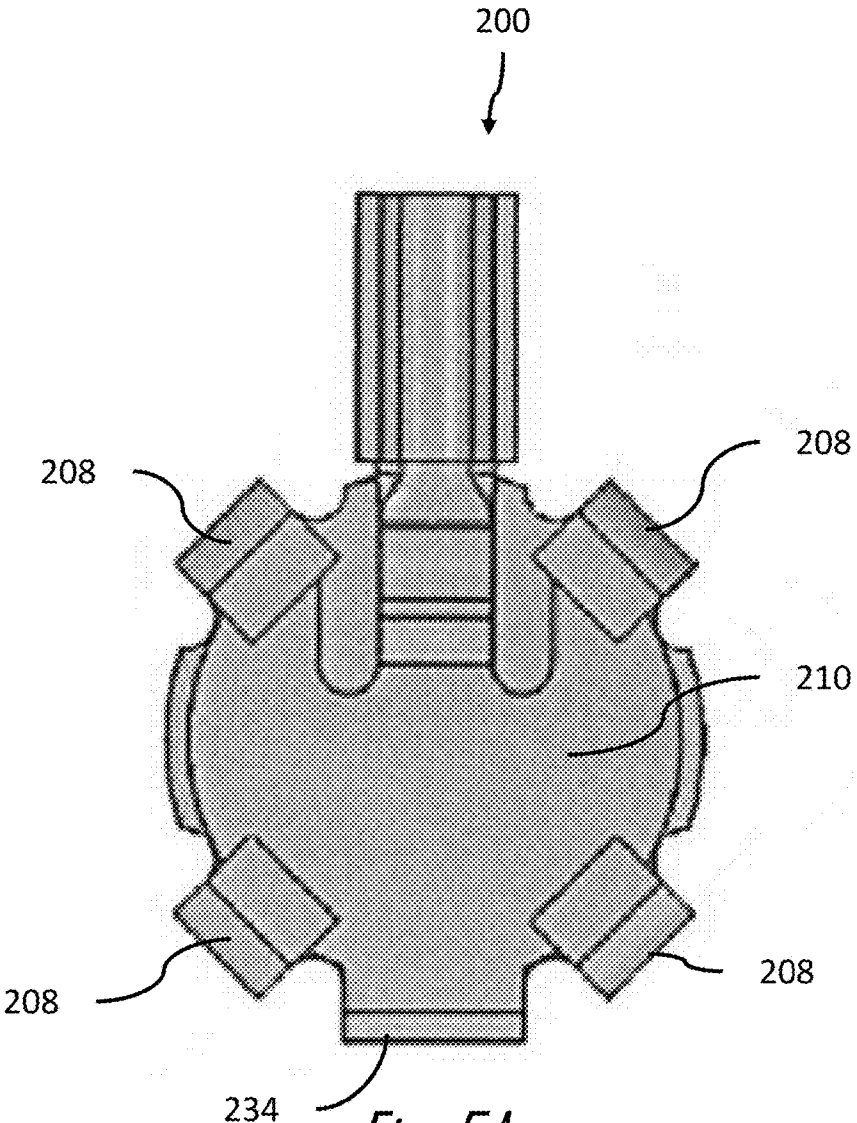
FIG. 5A is a top plan view of an electrical connector in accordance with a second embodiment of the invention.

Examples of electrical terminals that may be soldered to a conductive material applied to a glass surface of an automotive to provide electrical communication with an electrical device, such as an antenna or defroster formed on or in the glass, so that the electrical device may be electrically connected to associated equipment by an electrical cable are presented herein and illustrated in FIGS. 1-5B. A method of forming such an electrical terminal is also presented herein and illustrated in FIGS. 6 and 7. The electrical terminal, hereinafter referred to as the terminal 100, includes a planar base portion 102 having a base portion outer surface 104, a base portion inner surface 106, and two securing tabs 108 extending from an edge of the base portion 102. The terminal 100 also includes a planar attachment portion 110 having an attachment portion outer surface 112, an attachment portion inner surface 114, and an attachment member 116 extending from the attachment portion outer surface 112. The attachment member 116 is configured to secure a wire cable (not shown). The base portion inner surface 106 is arranged such that it is in contact with the attachment portion inner surface 114 and the two securing tabs 108 are bent over the attachment portion outer surface 112. The securing tabs are arranged in opposition to one another. According to a first example of the terminal 100 shown in FIGS. 1-4F, the securing tables are offset by about 180° and a width dimension of each of the two securing tabs 108 is equal to 25% or more of a circumferential dimension of the base portion 102. According to a second example of the terminal 200 shown in FIGS. 5A and 5B, the base portion 202 defines four securing tabs 208 that are offset from one another by about 90° configured to secure the base portion 202 to the attachment portion 210. Similarly to terminal 100, the base portion 202 is connected to the attachment portion 210 by a U-shaped strap or connecting member 234 extending from the base portion 202 to the attachment portions and integrally formed with the base portion 202 and attachment portion 210. The width dimension of each of the four securing tabs 208 is less than 25% of the circumferential dimension of the base portion 202. In alternative embodiments of the terminal, the base portion may be attached to the attachment portion by other means, e.g. welding or electrically conductive adhesive.

The terminal 100 is formed of sheet metal and has a generally curved outer perimeter or edge. The base portion 102 has a first curved perimeter 118 that is generally circular in shape. The attachment portion 110 has a second curved perimeter 120 that is also generally circular in shape. A first diameter of the base portion 102 is greater than a second diameter of the attachment portion 110. The base portion outer surface 104 may be pre-coated with a layer of solder for facilitating the soldering process.

The attachment member 116 extends beyond the outer perimeter of the attachment portion 110 and is configured to crimp the terminal 100 to a wire electrical cable. The slots 122 extend from the outer perimeter of the attachment portion 110, inwardly about halfway to the center line of the attachment portion 110, thereby forming two wings thereof. The attachment member 116 has an intermediate portion 124 which is bent upwardly at an angle from the proximal end 126 at about the outer perimeter. The distal end 128 of the attachment member 116 includes a crimping portion 130 having two opposed crimping tabs 132 for crimping to an inner conductor wire of the cable (not shown). The attachment member 116 is bent between the intermediate portion 124 and the distal end 128 so that the distal end 128 is positioned parallel to and laterally offset from the attachment portion 110 as well as above the attachment portion outer surface 112.

The base portion 102 is integrally formed with the attachment portion 110. The base portion 102 is connected to the attachment portion 110 by a U-shaped strap or connecting member 134 extending from the base portion 102 to the attachment portions and integrally formed with the base portion 102 and attachment portion 110.

In use, the terminal 100 is typically soldered to a glass substrate. The base portion 102 is generally circular in shape and does not tend to cause heat related stress concentrations in glass, and therefore, little or no cracking occurs during the soldering process. The proximal end 126 of the attachment member 116 extends from the attachment portion 110 and so does not interrupt the circular shape of base portion 102. Once soldered, any accidental pulling forces on cable are transferred to the center of base portion 102 because the proximal end 126 of the attachment member 116 extends therefrom. Consequently, the terminal 100 is resistant to being separated from glass.

The base portion 102 and attachment portion 110 are sized, shaped, and arranged such that forces exerted on the attachment member 116 by the wire cable are laterally distributed across the base portion 102. In addition, the upwardly angled intermediate portion 124 of the attachment member 116 is able to bend or deflect thereby absorbing forces exerted on the terminal 100 by cable. This may lessen the intensity of forces exerted on the base portion 102 by accidental pulling of the cable. For example, if a longitudinal pulling force is exerted on the cable, intermediate portion 124 would bend slightly to the left and absorb some of the force. In addition, if an upward pulling force is exerted on the cable, intermediate portion 124 would bend slightly upwardly and absorb some of the force. The angled intermediate portion 124 is also able to absorb forces that are forwardly and downwardly directed forces. Furthermore, the proximal end 126 of the attachment member 116 may also bend or deflect to absorb forces.

According to one example, the terminal 100 is formed of C260 brass, the base portion 102 is about 9 mm in diameter, and the terminal 100 is about 13 mm in length. Alternately, the terminal 100 may be formed of other conductive sheet materials. The intermediate portion 124 is bent at about a 45° angle to provide equal force absorbing capabilities for longitudinal and vertical forces. The dimensions of terminal 100 may be varied to suit particular circumstances. Although intermediate portion 124 is preferably bent, alternatively, the intermediate portion 124 may be straight. In addition, the proximal end 126 may be bent instead of the intermediate portion 124.

The terminal 100 is formed by a stamping and forming process 300 from a terminal preform 400. The terminal preforms 400 may be attached to a carrier strip 444 by severable regions 446 extending from the crimping portion 130 of the attachment member 416 or the connecting member 430 in order to facilitate handling and processing of multiple terminals. The carrier strip 444 may be cut into to form a multiple terminal soldering assembly, so that multiple terminals may be soldered to glass at the same time. Cables may be crimped to terminals before soldering.

Figure 6:
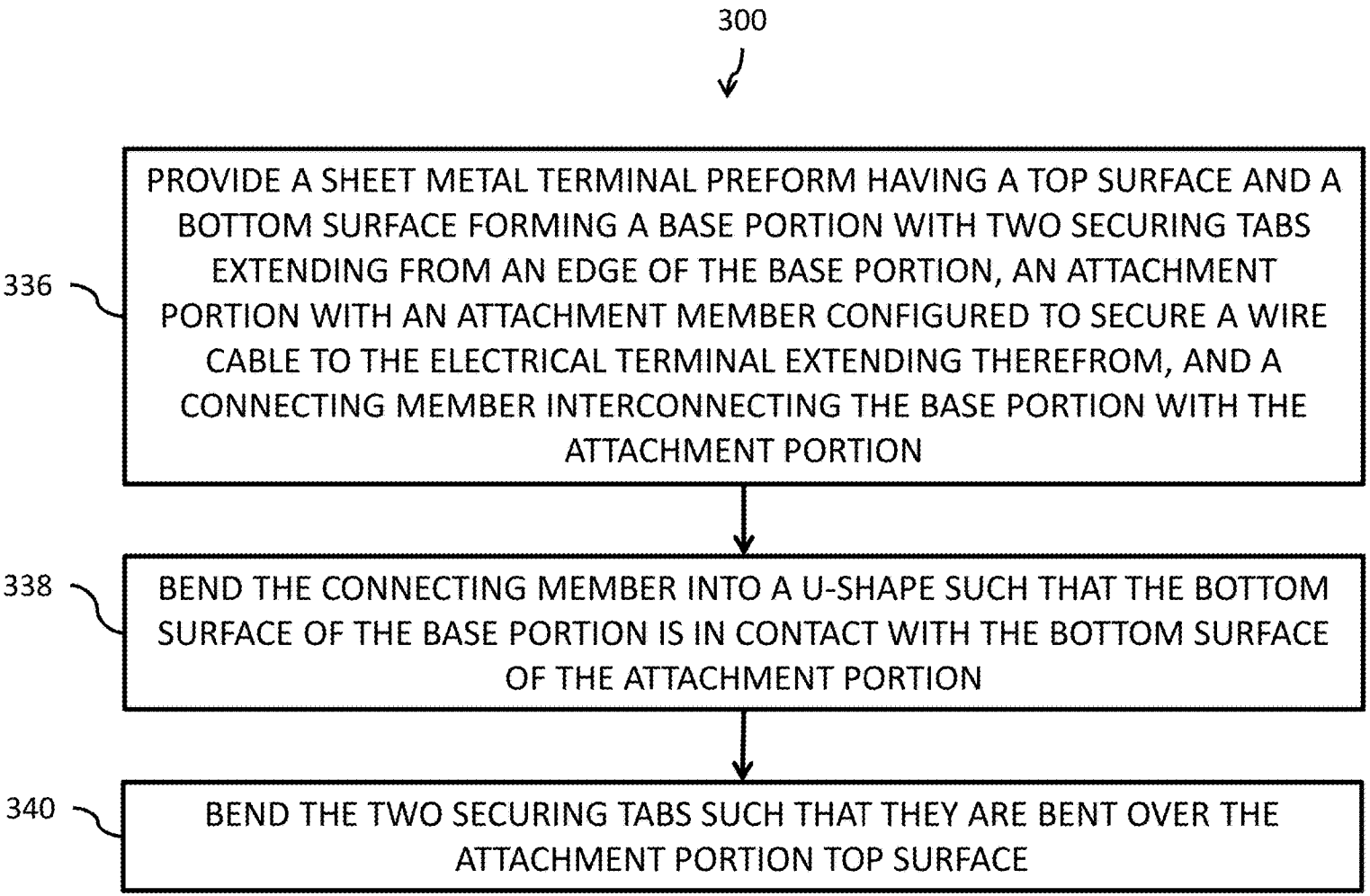
FIG. 6 is a flow chart of a method of forming an electrical connector in accordance with a third embodiment of the invention and FIG. 7 is a top plan view of a terminal preform used for forming the electrical connector in accordance with the third embodiment of the invention.
Figure 7:
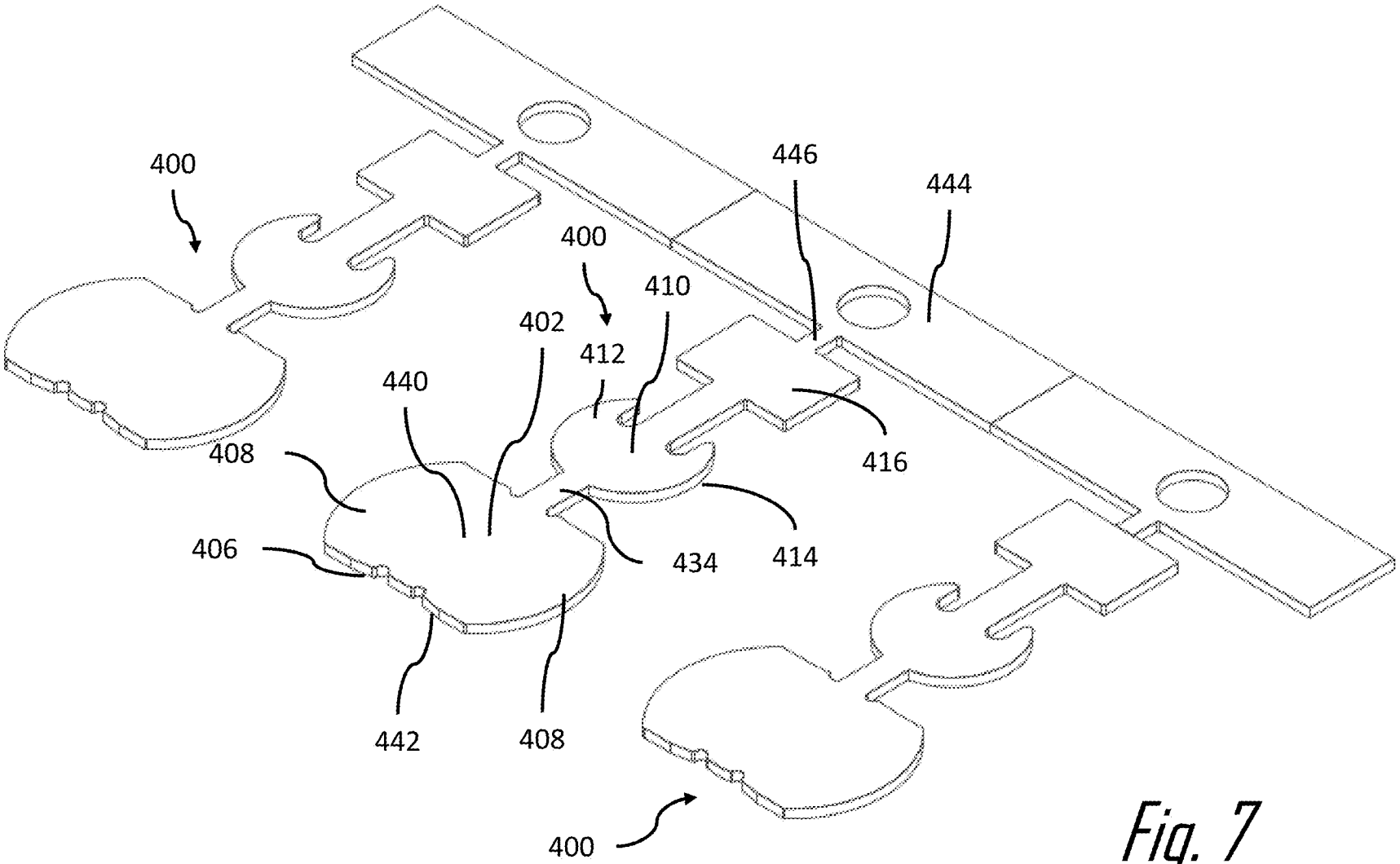

A method or process 300 of forming the terminals 100, 200 is shown in flowchart form in FIG. 6 and is described below:

STEP 336, PROVIDE A SHEET METAL TERMINAL PREFORM HAVING A TOP SURFACE AND A BOTTOM SURFACE FORMING A BASE PORTION WITH TWO SECURING TABS EXTENDING FROM AN EDGE OF THE BASE PORTION, AN ATTACHMENT PORTION WITH AN ATTACHMENT MEMBER CONFIGURED TO SECURE A WIRE CABLE TO THE ELECTRICAL TERMINAL EXTENDING THEREFROM, AND A CONNECTING MEMBER INTERCONNECTING THE BASE PORTION WITH THE ATTACHMENT PORTION, includes providing a terminal preform 400, as shown in FIG. 7, having a top surface 440 and a bottom surface 442 forming a base portion 402 with two securing tabs 408 extending from an edge of the base portion 402, an attachment portion 410 with an attachment member 416 configured to secure a wire cable to the electrical terminal extending therefrom, and a connecting member 434 interconnecting the base portion 402 with the attachment portion 410. The terminal preform 400 is formed from sheet metal using conventional sheet metal cutting processes, such as stamping, blanking, or cutting;

STEP 338, BEND THE CONNECTING MEMBER INTO A U-SHAPE SUCH THAT THE BOTTOM SURFACE OF THE BASE PORTION IS IN CONTACT WITH THE BOTTOM SURFACE OF THE ATTACHMENT PORTION, includes bending the connecting member into a U-shape such that the base portion bottom surface 406 is in contact with the attachment portion bottom surface 414; and STEP 340, BEND THE TWO SECURING TABS SUCH THAT THEY ARE BENT OVER THE ATTACHMENT PORTION TOP SURFACE, includes bending the two securing tabs 408 such that they are bent over the attachment portion top surface 412, thereby securing the base portion 402 to the attachment portion 410.

Accordingly, terminals 100, 200 and a method 300 of forming such terminals 100, 200 is provided. These terminals 100, 200 advantageously provide a base portion 102, 202 in the form of an uninterrupted circle that are less prone to cracking glass when being soldered thereto, The base portion 102, 202 also provides a greater surface area than prior art terminals that had interruptions or gaps in the base portion.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

We claim:

1. An electrical terminal, comprising:

a planar base portion having a base portion outer surface, a base portion inner surface, and two securing tabs extending from an edge of the base portion;

a planar attachment portion having an attachment portion outer surface, an attachment portion inner surface, and an attachment member extending from the attachment portion outer surface and configured to secure a wire cable, wherein the base portion inner surface is arranged such that it is in contact with the attachment portion inner surface and the two securing tabs are bent over the attachment portion outer surface.

2. The electrical terminal in accordance with claim 1, wherein the base portion is integrally formed with the attachment portion and wherein the base portion is connected to the attachment portion by a U-shaped connecting member.

3. The electrical terminal in accordance with claim 1, wherein the two securing tabs are arranged in opposition to one another.

4. The electrical terminal in accordance with claim 1, wherein a width dimension of each of the two securing tabs is equal to 25% or more of a circumferential dimension of the base portion.

5. The electrical terminal in accordance with claim 1, wherein the base portion has a first curved perimeter that is generally circular in shape and wherein the attachment portion has a second curved perimeter that is generally circular in shape.

6. The electrical terminal in accordance with claim 5, wherein a first diameter of the base portion is greater than a second diameter of the attachment portion.

7. The electrical terminal in accordance with claim 1, wherein the attachment member comprises an arm that extends from the attachment portion such that forces exerted on the attachment member by the wire cable are directed to a central region of the electrical terminal, and wherein the attachment member is configured to be deformed to secure the electrical terminal to the wire cable.

8. The electrical terminal in accordance with claim 7, wherein the base portion and attachment portion are sized, shaped, and arranged such that forces exerted on the attachment member by the wire cable are laterally distributed across the base portion.

9. A method of forming an electrical terminal, comprising the steps of:

providing a sheet metal terminal preform having a top surface and a bottom surface forming a base portion with two securing tabs extending from an edge of the base portion, an attachment portion with an attachment member configured to secure a wire cable to the electrical terminal extending therefrom, and a connecting member interconnecting the base portion with the attachment portion;

bending the connecting member into a U-shape such that the bottom surface of the base portion is in contact with the bottom surface of the attachment portion; and bending the two securing tabs such that they are bent over the attachment portion top surface.

10. The method in accordance with claim 9, wherein the attachment member comprises an arm that extends from the attachment portion such that forces exerted on the attachment member by the wire cable are directed to a central region of the electrical terminal.

11. The electrical terminal in accordance with claim 9, wherein the two securing tabs are arranged in opposition to one another and wherein a width dimension of each of the two securing tabs is equal to 25% or more of a circumferential dimension of the base portion.

12. The method in accordance with claim 9, wherein the base portion has a first curved perimeter that is generally circular in shape and wherein the attachment portion has a second curved perimeter that is generally circular in shape.

13. The method in accordance with claim 12, wherein a first diameter of the base portion is greater than a second diameter of the attachment portion.

14. The electrical terminal in accordance with claim 9, wherein the attachment member is configured to be deformed to secure the electrical terminal to the wire cable.

15. The electrical terminal in accordance with claim 14, wherein the two securing tabs are arranged in opposition to one another and wherein a width dimension of each of the two securing tabs is equal to 25% or more of a circumferential dimension of the base portion.

16. An electrical terminal formed by a process comprising the steps of:

providing a sheet metal terminal preform having a top surface and a bottom surface forming a base portion with two securing tabs extending from an edge of the base portion, an attachment portion with an attachment member configured to secure a wire cable to the electrical terminal extending therefrom, and a connecting member interconnecting the base portion with the attachment portion;

bending the connecting member into a U-shape such that the bottom surface of the base portion is in contact with the bottom surface of the attachment portion; and bending the two securing tabs such that they are bent over the attachment portion top surface.

17. The electrical terminal in accordance with claim 16, wherein the attachment member comprises an arm that extends from the attachment portion such that forces exerted on the attachment member by the wire cable are directed to a central region of the electrical terminal.

18. The electrical terminal in accordance with claim 16, wherein the attachment member is configured to be deformed to secure the electrical terminal to the wire cable.

19. The electrical terminal in accordance with claim 16, wherein the base portion has a first curved perimeter that is generally circular in shape and wherein the attachment portion has a second curved perimeter that is generally circular in shape.

20. The electrical terminal in accordance with claim 19, wherein a first diameter of the base portion is greater than a second diameter of the attachment portion.

* * * * *